US012392209B1

(12) United States Patent
Wiesenborn et al.

(10) Patent No.: US 12,392,209 B1
(45) Date of Patent: Aug. 19, 2025

(54) DEBRIS COLLECTION AND REMOVAL FROM A WELLBORE

(71) Applicant: SCHLUMBERGER TECHNOLOGY CORPORATION, Sugar Land, TX (US)

(72) Inventors: Robert Kyle Wiesenborn, Richmond, TX (US); Philip Stevenson, Sugar Land, TX (US); Todor Sheiretov, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/994,919

(22) PCT Filed: Jul. 19, 2023

(86) PCT No.: PCT/US2023/028141

§ 371 (c)(1),
(2) Date: Jan. 15, 2025

(87) PCT Pub. No.: WO2024/020095

PCT Pub. Date: Jan. 25, 2024

Related U.S. Application Data

(60) Provisional application No. 63/368,814, filed on Jul. 19, 2022.

(51) Int. Cl.

| | |
|---|---|
| ***E21B 27/04*** | (2006.01) |
| ***E21B 7/00*** | (2006.01) |
| ***E21B 10/44*** | (2006.01) |

(52) U.S. Cl.
CPC ..... *E21B 27/04* (2013.01); *E21B 7/005* (2013.01); *E21B 10/44* (2013.01)

(58) Field of Classification Search
CPC ..... E21B 27/04; E21B 7/005; E21B 10/44
See application file for complete search history.

(56) References Cited

U.S. PATENT DOCUMENTS

| | | | | |
|---|---|---|---|---|
| 2,187,845 | A | 1/1940 | Tatalovich | |
| 2,990,896 | A * | 7/1961 | Kandle | E21B 10/327 175/323 |

(Continued)

FOREIGN PATENT DOCUMENTS

| | | |
|---|---|---|
| DK | 180023 B1 | 1/2020 |
| NO | 315212 B1 | 7/2003 |

(Continued)

OTHER PUBLICATIONS

International Preliminary Report on Patentability issued in the PCT Application No. PCT/US2023/028141 dated Jan. 30, 2025, 6 pages.

(Continued)

*Primary Examiner* — Blake Michener
(74) *Attorney, Agent, or Firm* — Jeffrey D. Frantz

(57) ABSTRACT

Systems and methods are disclosed herein for improved debris collection within a wellbore. An example method can include inserting a tool into a wellbore, where the tool includes an input shaft, an auger shaft, and a collection chamber. The input shaft can be rotated in a first direction, causing rotation of the auger shaft. The rotation of the auger shaft conveys debris into the collection chamber. The input shaft can also be rotated in a second direction, which causes the auger shaft to retract within the collection chamber. The retraction of the auger shaft within the collection chamber prevents the debris from escaping the collection chamber. The tool can then be removed from the wellbore while preventing the collected debris from escaping the collection chamber.

18 Claims, 7 Drawing Sheets

(56) References Cited

U.S. PATENT DOCUMENTS

| | | | | |
|---|---|---|---|---|
| 3,938,344 | A * | 2/1976 | Asayama | E02D 5/48 175/171 |
| 5,067,570 | A * | 11/1991 | Gilcrease | E21B 19/086 175/161 |
| 5,251,701 | A * | 10/1993 | Williams | E21B 27/04 175/323 |
| 5,299,639 | A | 4/1994 | Williams et al. | |
| 10,781,637 | B1 * | 9/2020 | Hall | E21B 7/028 |
| 11,401,748 | B2 * | 8/2022 | Kontras | E21B 17/07 |
| 2019/0055802 | A1 | 2/2019 | Haugland et al. | |
| 2020/0248519 | A1 | 8/2020 | Haugland | |

FOREIGN PATENT DOCUMENTS

| | | | |
|---|---|---|---|
| WO | 2003036020 | A1 | 5/2003 |
| WO | 2012088132 | A2 | 6/2012 |

OTHER PUBLICATIONS

International Search Report and Written Opinion of International Patent Application No. PCT/US2023/028141 dated on Nov. 9, 2023, 09 pages.

* cited by examiner

DEBRIS COLLECTION AND REMOVAL FROM A WELLBORE

CROSS-REFERENCE TO RELATED APPLICATION

This application is the National Stage Entry of International Application No. PCT/US2023/028141, filed Jul. 19, 2023, which claims priority to U.S. Provisional Patent Application No. 63/368,814, filed on Jul. 19, 2022, which is incorporated by reference herein.

BACKGROUND

Field

The present disclosure generally relates to a downhole tool, and more particularly to methods and apparatus for loosening and collecting wellbore debris.

Description of the Related Art

Hydrocarbons may be produced from wellbores drilled from the surface through a variety of producing and non-producing formations. The wellbore may be drilled substantially vertically or may be an offset well that is not vertical and has some amount of horizontal displacement from the surface entry point. Often debris needs to be removed from the wellbore after it is drilled. Wellbore debris can include sand, scale, metallic junk, proppant, and other solids that may be mixed with pipe dope or asphaltenes. One of the challenges in designing a tool for removing debris is to provide a means to retain collected debris inside the collection chambers while the tool is being retrieved from the well.

SUMMARY

Systems and methods are disclosed herein for improved debris collection within a wellbore. An example method can include inserting a tool into a wellbore, where the tool includes an input shaft, an auger shaft, and a collection chamber. The input shaft can be rotated in a first direction, causing rotation of the auger shaft. The rotation of the auger shaft conveys debris into the collection chamber, such as by conveying debris-laden fluid through the collection chamber. The input shaft can also be rotated in a second direction, which causes the auger shaft to retract within the collection chamber. The retraction of the auger shaft within the collection chamber prevents the debris from escaping the collection chamber. The tool can then be removed from the wellbore while preventing the collected debris from escaping the collection chamber.

The debris can be retained in the collection chamber based on the collection chamber contacting at least a portion of the auger shaft while the auger shaft is retracted within the collection chamber. For example, the collection chamber can create a seal by contacting the auger shaft with sufficient force and in a location that prevents debris from escaping an internal volume of the collection chamber.

The auger shaft can be retracted based on rotation of the input shaft in the second direction. Such rotation of the input shaft can cause no rotation of the auger shaft, instead causing it to move axially. This can be achieved by using a selective torque-coupling device to engage or disengage, such that rotation of the input shaft does not cause rotation of the auger shaft. Retraction of the auger shaft can be accomplished by the interaction of screw threads of the input shaft and screw threads of another component. Similarly, the selective torque-coupling device can be configured to allow interaction between screw threads of the input shaft with another component. In one example, the auger shaft is retracted into the collection chamber by extending a sleeve associated with the collection chamber over the auger shaft.

In another example, debris can be retained in the collection chamber by compaction of the collected debris as the auger is retracted. Compaction can be accomplished by the tendency of the debris to remain stationary relative to the collection chamber walls as the auger shaft is retracted, or by using specialized geometry for example by including a wedge on the auger shaft that creates a converging surface as the auger shaft is retracted.

A debris collection tool is also disclosed for use with the methods described herein.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

An example apparatus for debris collection includes an auger shaft designed to be moveable at the debris collection end in the axial direction between an extended position and a retracted position using a powered screw. The axial motion of the auger shaft is accomplished using a retraction mechanism that converts rotary motion into a combination of rotary and axial motion depending on the direction or input shaft rotation.

Figure 1:
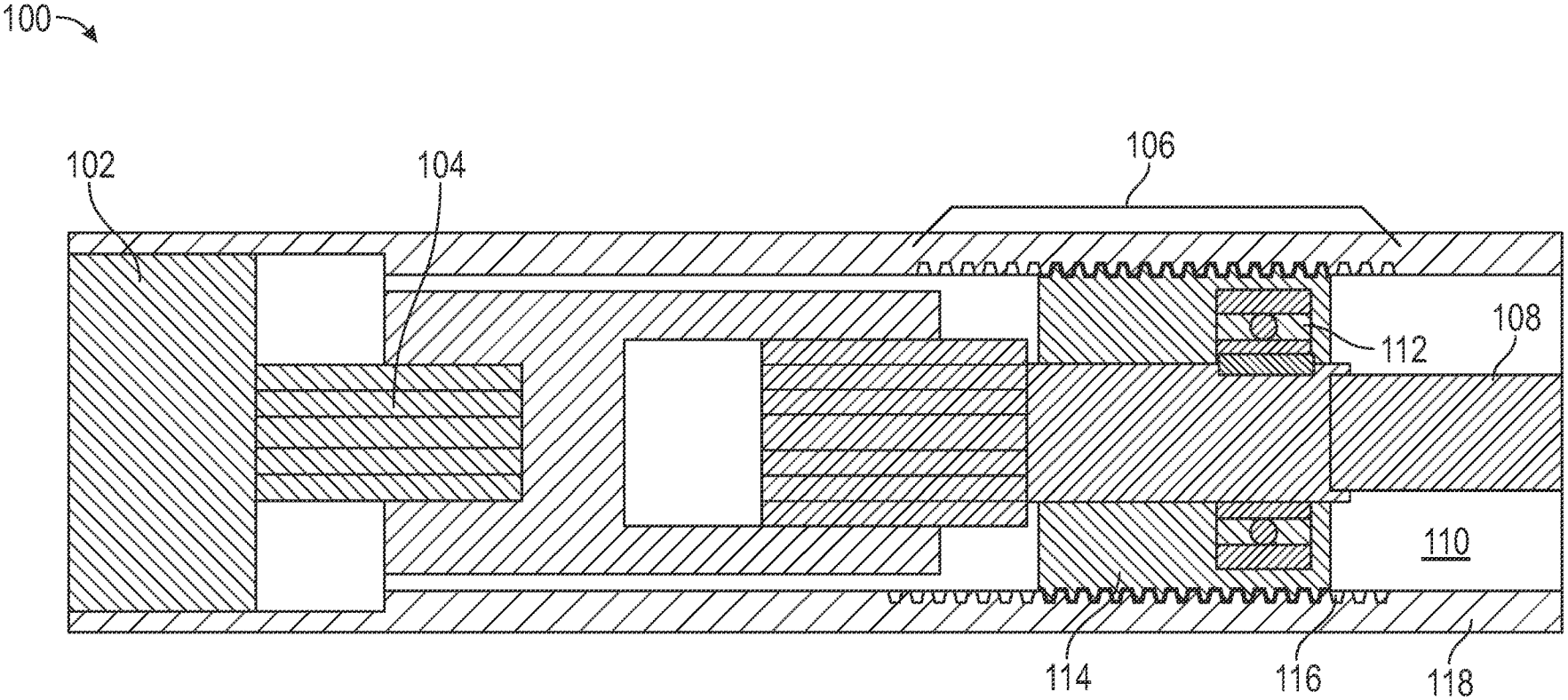
FIG. 1 shows a schematic of an example retraction mechanism of the debris removal apparatus, according to an embodiment of the disclosure.
Figure 5:
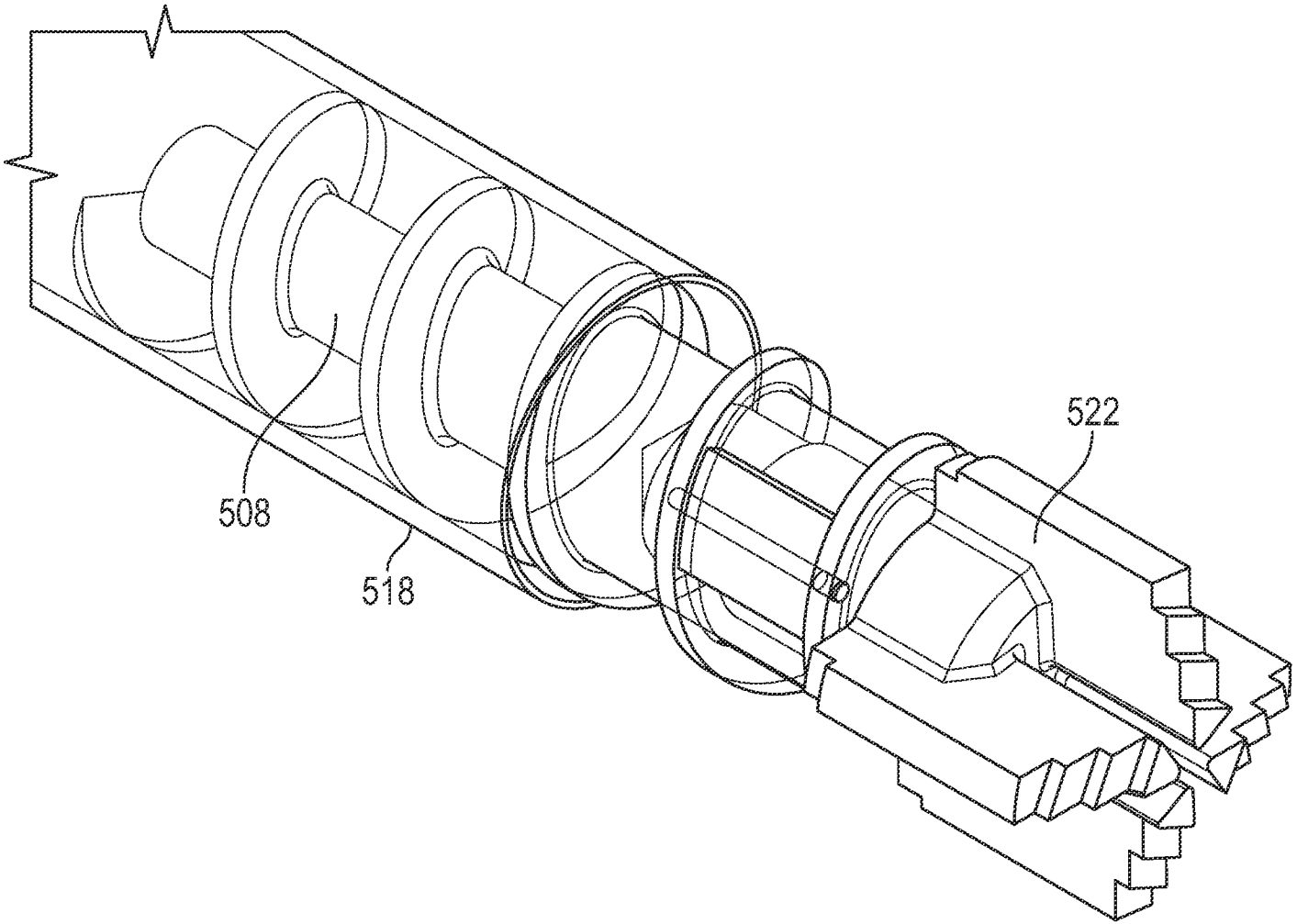
FIG. 5 shows a schematic of the collecting end of an example debris removal apparatus, with the auger shaft in the extended position, according to an embodiment of the disclosure.
Figure 6:
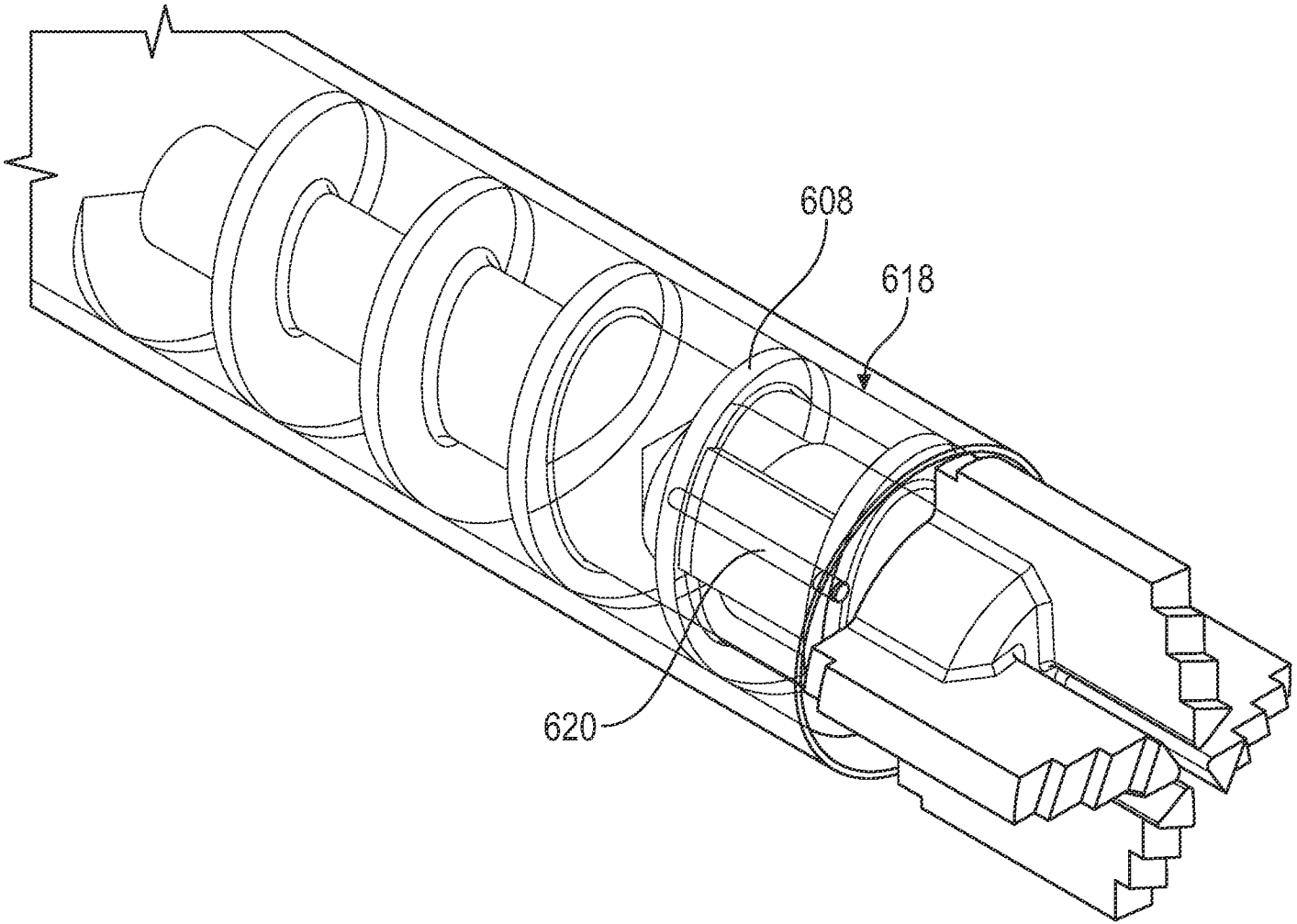
FIG. 6 shows a schematic of the collecting end of an example debris removal apparatus, with the auger shaft in the retracted position, according to an embodiment of the disclosure.
Figure 7A:
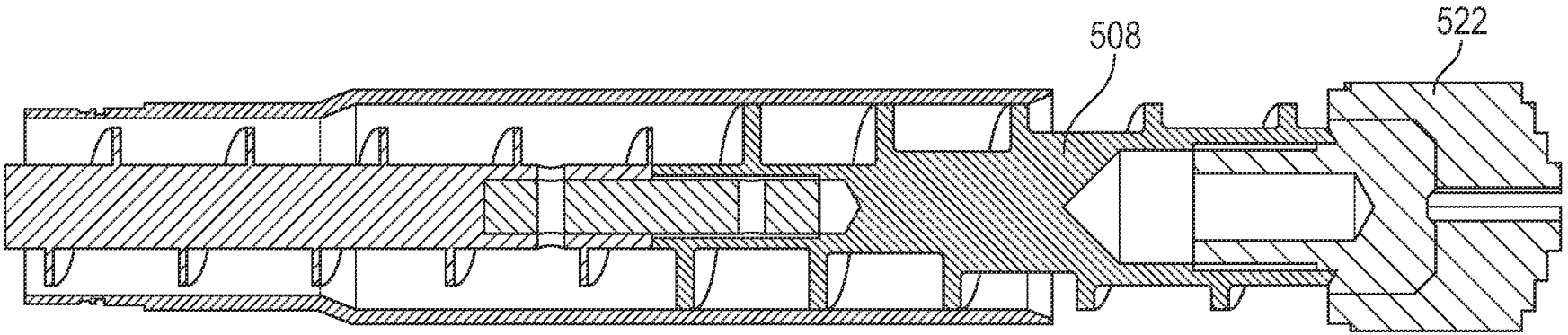
FIG. 7A & FIG. 7B show a schematic of the collecting end of an example debris removal apparatus, with the auger shaft in both extended and retracted positions, according to an embodiment of the disclosure.
Figure 7B:
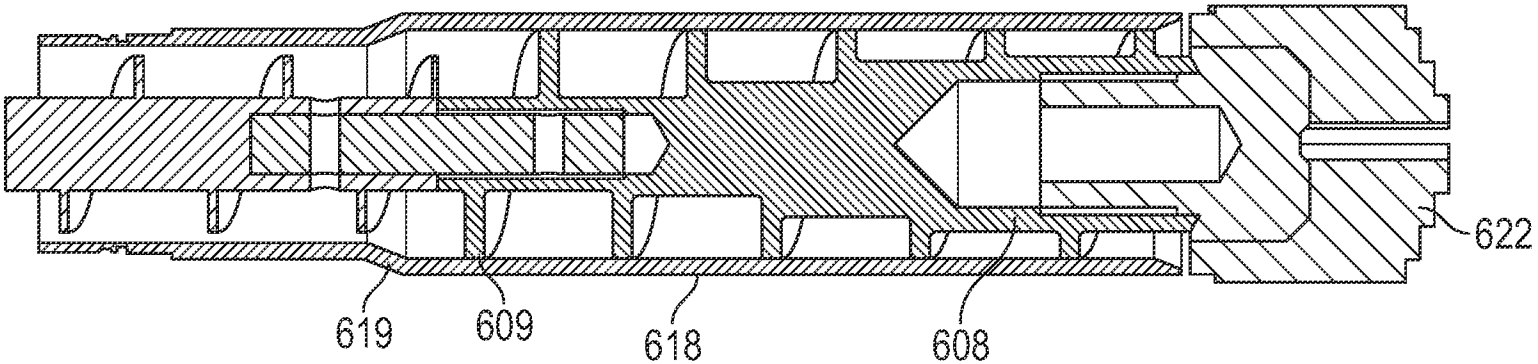

FIG. 1 shows a schematic of an example retraction mechanism of a debris removal apparatus 100, according to an embodiment of the disclosure. The debris removal apparatus 100 includes a motor 102, an input shaft 104, a screw section 106, an auger shaft 108, and a selective torque transmission mechanism 112 for coupling or decoupling torque transmission to the screw section 106. The auger shaft 108 conveys loosened debris into the collection chamber as illustrated in FIGS. 5, 6, and 7.

The debris removal apparatus 100 can include an extended position and a retracted position. In the extended position, the auger shaft 108 projects below an open end of the collection chamber 110 so that loosened debris can enter the auger and be conveyed into the collection chamber 110 as the auger shaft 108 is rotated relative to the borehole and collection chamber 110. In the retracted position, the auger shaft 108 is contained within the collection chamber 110 so that debris cannot enter or exit in the radial direction. In one embodiment, the auger shaft 108 may also include a portion at its lower end which can either contact the collection chamber 110 or form a close fit with the collection chamber 110 to prevent debris from escaping in the axial direction.

Axial motion of the auger shaft 108 in either direction is accomplished using the motor 102 to rotate the input shaft 104 in either the clockwise or the counter-clockwise direction. The selective torque transmission mechanism 112 can be used to covert rotary motion on the input side to a combination of rotary motion and linear motion on the output side when the input shaft is rotated in one direction. The selective torque transmission mechanism 112 transmits torque when the input shaft is rotated in one direction and allows slip when the input shaft is rotated in the opposite direction. For example, the screw section 106 can include an inner screw 114 with an external thread and an outer screw 116 with an internal thread. In an embodiment, the outer screw 116 can be part of the interior surface of the collection chamber housing 118 of the debris removal apparatus 100.

The selective torque transmission mechanism 112 can be any mechanism that can selectively allow or prevent relative rotation between the inner screw 114 and outer screw 116. The selective torque transmission mechanism may also be located between the input shaft 104 and a screw 114, the input shaft 104 and the auger shaft 108, or the inner screw 114 and outer screw 116. The selective torque transmission mechanism 112 can include various components for imparting selective rotation, such as clutches, a combination of clutches and intermediate shafts (shown in FIG. 2), one-sided keyways (shown in FIG. 3), and fluid-based torque converters. Torque transmission (or slip) between the input shaft 104 and a screw 114 and the input shaft 104 and the auger shaft 108. These mechanisms can result in different combinations of auger shaft rotation and/or axial motion in one or both directions for different modes of operation or for various other benefits. In one embodiment, rotating the screw 114 in the clockwise direction can result in the auger shaft 108 and screw 114 rotating together with no relative axial motion. Then when the screw 114 is rotated in the counter-clockwise direction the auger shaft 108 is prevented from rotating and the screw 114 generates an axial force on the auger shaft 108 to move it from the extended position to the retracted position. This and other various mechanisms for selective torque transmission can be used within the same overall system without affecting the primary concept and use of the embodiment.

Various configurations of the screw 114 as it relates to the input shaft 104 and auger shaft 108 can be used. In one embodiment, the input shaft 104 can be coupled to the inner screw 114 or the outer screw 116. In another embodiment, the inner screw 114 or the outer screw 116 can be free to rotate or can be selectively keyed to the housing 118 to prevent rotation. In another embodiment, the inner screw 114 and outer screw 116 can be included as a feature on the input shaft 104 or auger shaft 108, or they can be separate elements of the debris removal apparatus 100. The thread can be either right-hand convention or left-hand convention and may be made in various thread forms. The thread can also be constructed as a ball screw or other type of low-friction device for converting rotary motion to linear motion. The thread can be a multi-start thread or a single-start thread, and can be made in various diameters and pitches to convert torque and angular displacement to axial force and axial displacement. The input and output sides of the thread can also be reversed for resetting the debris removal apparatus 100, including a means for alternately locking different sides of the screw section 106 depending on the intended operating mode.

The motor 102 could be either electrically powered or hydraulically powered. The motor 102 can be a motor of any type that includes a means to allow input shaft rotation in either clockwise or counter-clockwise direction. In some embodiments, it is useful to know the applied torque on the motor 102 or the angular position of the motor 102, so the debris removal apparatus 100 can also include sensor (not shown) for, or some other means, of measuring these operating parameters, such as a measurement of motor power and an encoder on the motor shaft or screw. The motor 102 can be operated at a constant speed or a variable speed.

The debris removal apparatus 100 can convey debris into the collection chamber 110 by driving the input shaft 104 (and consequently the auger shaft 108) in one direction. When the debris removal apparatus 100 drives the input shaft in the opposite direction, the selective torque transmission mechanism 112 creates axial motion which moves the auger shaft 108 toward the collection chamber 110. Debris is allowed to enter the collection chamber when the auger shaft 108 is extended, and debris is prevented from exiting the collection chamber when the auger is retracted. In some embodiments, the debris removal apparatus 100 can include multiple motors: one for rotating the input shaft in the clockwise direction and another for rotating in the counter-clockwise direction.

Figure 2:
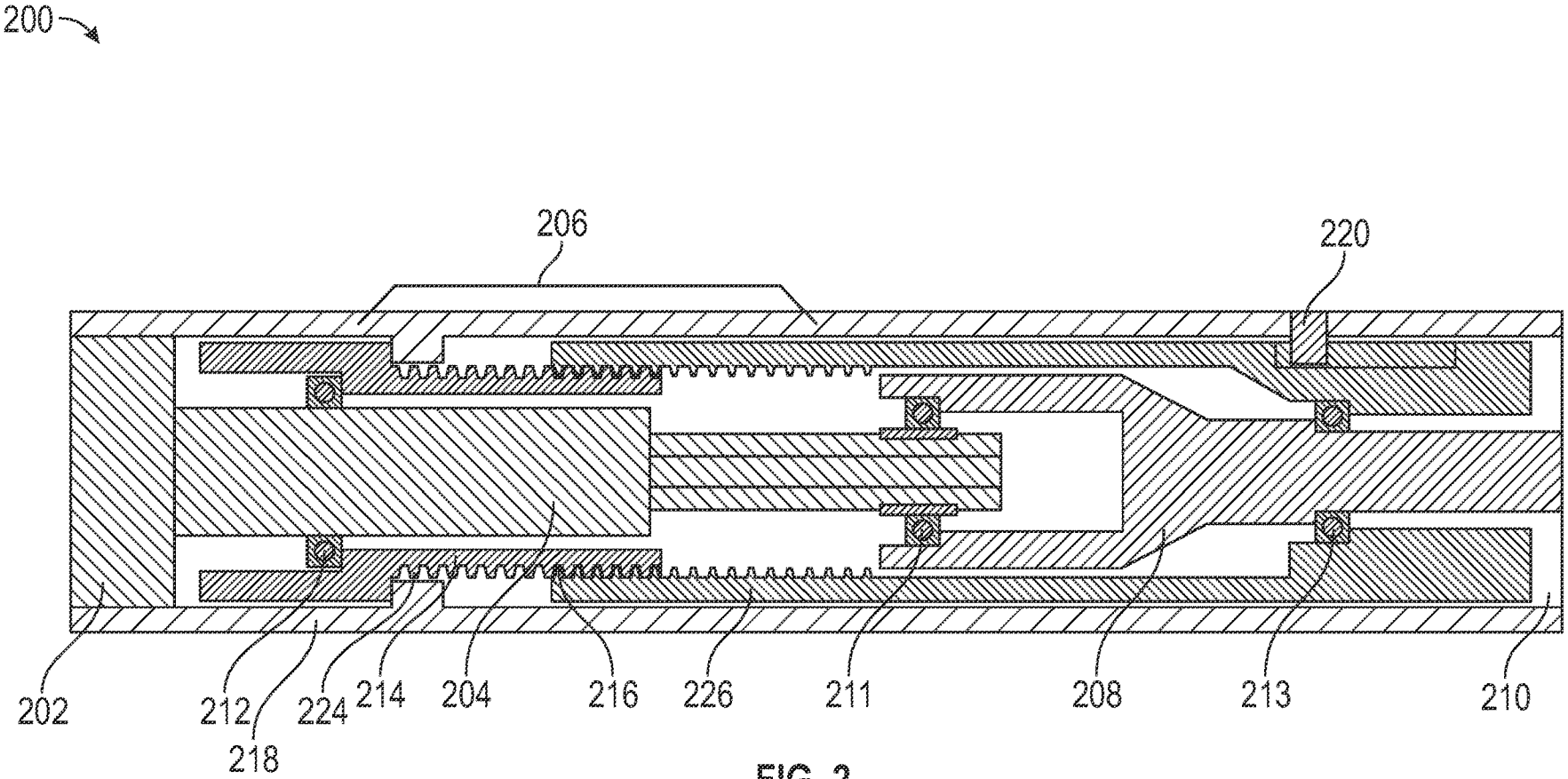
FIG. 2 shows a schematic of an example retraction mechanism of the debris removal apparatus, according to an embodiment of the disclosure.

FIG. 2 shows a schematic of another example of a retraction mechanism of the debris removal apparatus 200, according to an embodiment of the disclosure. The debris removal apparatus 200 includes similar components of the debris removal apparatus 100. For example, the debris removal apparatus 200 includes a motor 202, an input shaft 204, a screw section 206 with an inner screw 214 and an outer screw 216, an auger shaft 208, a collection chamber 210, a selective torque transmission mechanism created by a combination of clutches 211, 212, 213 and intermediate shafts 224, 226, and a housing 218. Unlike in the debris removal apparatus 100, apparatus 200 includes intermediate shaft 224, 226 that can be selectively coupled or decoupled from the auger shaft 208 using a pin 220 to limit rotation of the auger shaft 208 to a single direction.

Figure 3:
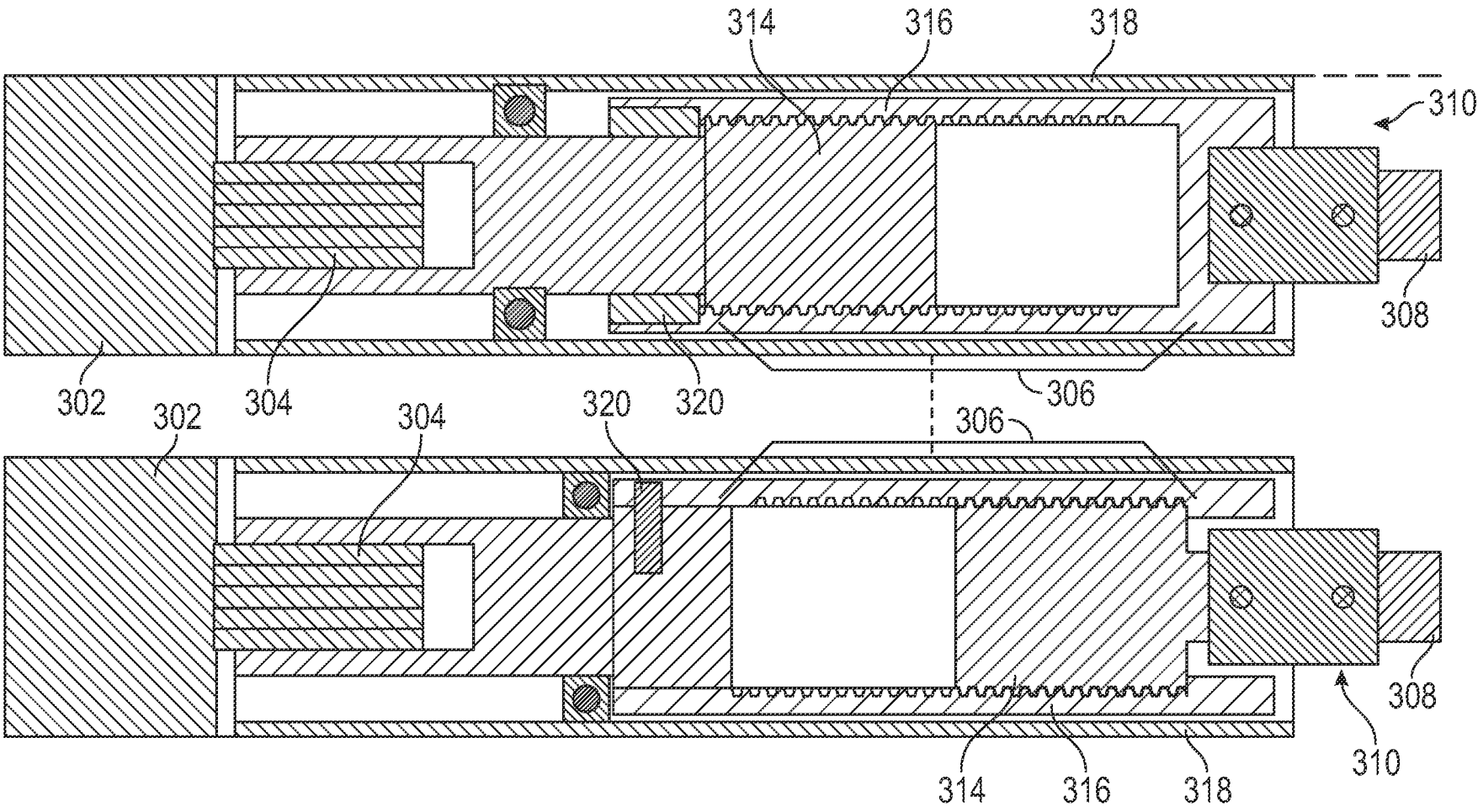
FIG. 3 shows a schematic of an example retraction mechanism of the debris removal apparatus, according to an embodiment of the disclosure.

FIG. 3 is an illustration of an example retraction mechanism of a debris removal apparatus 300 for removing and collecting debris from a wellbore, according to an embodiment of the disclosure. The debris removal apparatus 300 includes similar components of the debris removal apparatus 100. For example, the debris removal apparatus 300 includes a motor 302, an input shaft 304, a screw section 306 with an inner screw 314 and an outer screw 316, an auger shaft 308, a collection chamber 310, and a housing 318. With the debris removal apparatus 300, the torque transmission mechanism is created by axial contact between the inner screw 314 and outer screw 316, or between elements connected to the screws 314 and 316, which occurs at a certain point in the screw stroke length. This type of torque transmission mechanism can be constructed to transmit torque by contact friction between two surfaces normal to the screw axis, as depicted in FIG. 3. In some embodiments, the torque transmission mechanism can be in the form of a moveable key 320 that engages with a wide slot in the inner screw 314, the keyway in the inner screw 314 being one-sided to allow torque transmission when the input shaft 304 is rotated in one direction and screw translation when the input shaft 304 is rotated in the opposite direction.

Other types of torque transmission mechanisms that can be implemented include mechanisms that use activation by hydraulic pressure, rotational speed, or magnetic forces. A combination of these various torque transmission mechanisms is possible, and the torque transmission mechanism can be placed at various locations depending on the configuration and coupling of the input and output shafts and the inner and outer screws, all without affecting the overall concept disclosed.

Figure 4:
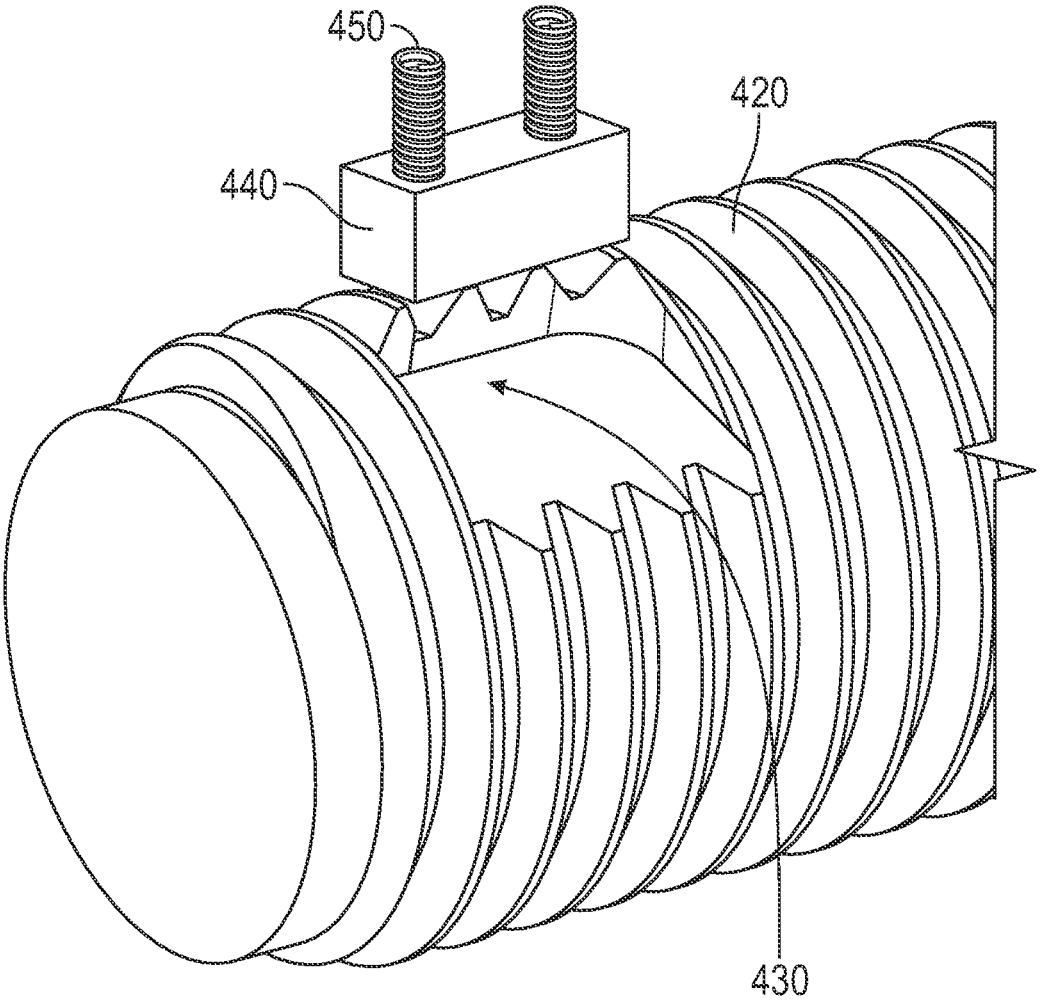
FIG. 4 shows an example selective torque coupling device, according to an embodiment of the disclosure.

FIG. 4 is an illustration of another embodiment of the retraction mechanism in which the inner screw 420 also incorporates the torque transmission mechanism in the same physical part. Selective torque transmission in this embodiment is accomplished using a one-sided keyway 430 on the inner screw 420 in combination with a moveable key 440. The combination of a one-sided keyway 430 and moveable key 440 allows torque transmission between the inner screw 420 and outer screw in one rotation direction but when the rotation direction is reversed the moveable key 440 is displaced radially outward and the inner screw 420 can rotate freely relative to the outer screw. The moveable key can include springs 450 to engage the key 440 with the one-sided keyway 430 at the desired axial position. The inner screw 420 can include multiple one-sided keyways 430 at different axial positions with different sides of the keyway designed to transmit torque in different directions depending on the axial position of the inner screw 420. The one-sided keyways 430 and moveable keys 440 can be used to create a retraction mechanism that allows torque transmission in one direction, then a defined axial travel distance when the shaft is rotated in the opposite direction, then torque transmission in the opposite direction when the moveable key contacts the next one-sided keyway.

In some examples, torque transmission mechanisms can include one or more one-way clutches. Some examples of such one-way clutches that can be used include ramped-roller designs and cam sprags. Without some additional connection, the overall mechanism is under constrained, meaning that it may be indeterminant whether motion on the input shaft resulted in axial translation, rotation of the output shaft, or both. Ideally, the additional connections can guarantee that the desired type of motion is achieved in each circumstance regardless of relative torques inside and outside the mechanism.

As discussed previously, embodiments of a debris removal apparatus can include an extended position and a retracted position. FIG. 5 is an illustration of an isometric view of an auger shaft 508 of a debris removal tool in an extended position. A wellbore drill bit 522 is coupled to one axial end of the auger 508. While in the extended position, a portion of the auger 508 is exposed, allowing the auger 508 to collect debris and move the debris to a collection chamber 518. An illustration of a section view of the auger shaft 508 in an extended position is included in FIG. 7A.

FIG. 6 is an illustration of an auger shaft 608 of a debris removal tool in a retracted position. A wellbore drill bit 622 is coupled to one axial end of the auger 608. However, as shown in FIG. 6, in the retracted position the auger 608 is not exposed because the auger 608 is completely covered by the collection chamber housing 618. As a result, the auger 608 does not lose any debris from the radial direction while in the retracted position. The auger shaft can also include a closure insert 620 that prevents debris from being lost from the collection chamber in the axial direction. The closure insert 620 could be a solid piece of material or could be additional auger flighting that does not provide a complete seal but rather slows the leakage of collected debris or compacts debris as a result of reduced cross-sectional area. An illustration of a section view of the auger shaft 608 in a retracted position is included in FIG. 7B.

The auger shaft 608 can also include a flexible portion of auger flighting that allows passage of debris into the collection chamber 618 when the auger is extended. When the auger shaft 608 is retracted the flexible flighting is deformed so that it blocks passage of debris out of the collection chamber.

Debris can also be prevented from escaping from the collection chamber in the axial direction by compaction of the collected debris as the auger shaft is retracted, where the compacted debris is held stationary relative to the collection chamber from frictional forces. The frictional forces may be developed by forcing collected debris toward converging surfaces during the retraction process and the auger shaft or collection chamber may include geometric features to encourage compaction of collected debris during retraction.

In one embodiment the collection chamber 618 can include a reduced inside diameter with tapered edge 619 that forces debris toward the center as the auger shaft is retracted. In another embodiment, the auger shaft 608 can include a larger diameter section 609 that forces debris against the collection chamber or against previously collected debris as the auger shaft is retracted.

Compaction of collected debris can also be accomplished as collected debris tries to escape from the collection chamber in the direction of gravity and the auger shaft or collection chamber may include geometry which creates converging surfaces as collected debris escapes in the direction of gravity, for example the auger shaft may include a section of flighting with multiple starts or more closely spaced pitch. The converging surfaces may be formed as a result of retraction of the auger shaft, for example by retracting a lower portion of auger shaft flighting with closely spaced pitch or multiple starts into the collection chamber.

In some embodiments, the shaft is fixed in the axial direction and results in axial motion of the housing. These embodiments may include ones where there is a separate concentric housing around the main housing which extends relative to the end of the main housing to accomplish a similar radial, axial, or helical debris stop.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A method for improved debris collection within a wellbore, comprising:

inserting a tool into a wellbore, the tool comprising an input shaft, an auger shaft, and a collection chamber;

rotating the input shaft in a first direction, wherein the rotation of the input shaft in the first direction causes rotation of the auger shaft, and wherein rotation of the auger shaft causes debris to be conveyed into the collection chamber; and rotating the input shaft in a second direction, wherein the rotation of the input shaft in the second direction causes the auger shaft to retract within the collection chamber, wherein the retraction of the auger shaft within the collection chamber prevents the debris from escaping the collection chamber.

2. The method of claim 1, further comprising removing the tool from the wellbore while the auger shaft remains within the collection chamber.

3. The method of claim 1, wherein the collection chamber is shaped to contact the auger shaft when the auger shaft is in a retracted position.

4. The method of claim 3, wherein the contact creates a seal that separates a volume within the collection chamber from a volume outside the collection chamber.

5. The method of claim 1, wherein rotating the input shaft in the second direction causes no rotation of the auger shaft.

6. The method of claim 1, wherein rotating the input shaft in the second direction causes a torque-coupling device to engage or disengage.

7. The method of claim 1, wherein the retraction of the auger shaft is caused by the interaction of screw threads of the input shaft and screw threads of another component.

8. The method of claim 1, wherein a torque-coupling device is configured to selectively allow interaction of screw threads of the input shaft with another component.

9. The method of claim 1, wherein the retraction of the auger shaft is caused by extending a sleeve of the collection chamber over the auger shaft.

10. A debris collection tool for improved debris collection within a wellbore, comprising:

an input shaft configured to be selectively rotated in either a first direction or a second direction;

an auger shaft configured to rotate based on the input shaft rotating in the first direction, said rotation of the auger shaft configured to convey debris; and a collection chamber shaped to receive the debris conveyed by the auger shaft, wherein the auger shaft is further configured to retract within the collection chamber based on rotation of the input shaft in the second direction.

11. The tool of claim 10, wherein the auger shaft remains within the collection chamber when the tool is removed from the wellbore.

12. The tool of claim 10, wherein the collection chamber is shaped to contact the auger shaft when the auger shaft is in a retracted position.

13. The tool of claim 12, wherein the contact creates a seal that separates a volume within the collection chamber from a volume outside the collection chamber.

14. The tool of claim 10, wherein rotating the input shaft in the second direction causes no rotation of the auger shaft.

15. The tool of claim 10, wherein rotating the input shaft in the second direction causes a torque-coupling device to engage or disengage.

16. The tool of claim 10, wherein the retraction of the auger shaft is caused by the interaction of screw threads of the input shaft and screw threads of another component.

17. The tool of claim 10, wherein a torque-coupling device is configured to selectively allow interaction of screw threads of the input shaft with another component.

18. The tool of claim 10, wherein the retraction of the auger shaft is caused by extending a sleeve of the collection chamber over the auger shaft.

* * * * *